US008070563B2

(12) United States Patent
Viscomi et al.

(10) Patent No.: US 8,070,563 B2
(45) Date of Patent: Dec. 6, 2011

(54) WHET-STONE RECEPTACLE AND HAND GUARD

(76) Inventors: Brian D. Viscomi, Easton, PA (US); Howard S Glazer, Paramus, NJ (US)

( * ) Notice: Subject to any disclaimer, the term of this patent is extended or adjusted under 35 U.S.C. 154(b) by 531 days.

(21) Appl. No.: 12/378,005

(22) Filed: Feb. 10, 2009

(65) Prior Publication Data

US 2009/0203301 A1 Aug. 13, 2009

Related U.S. Application Data

(60) Provisional application No. 61/065,599, filed on Feb. 13, 2008.

(51) Int. Cl.
*B24D 15/06* (2006.01)

(52) U.S. Cl. ..... 451/451; 451/555; 451/557

(58) Field of Classification Search ..... 451/451, 451/552, 555–558, 523–525
See application file for complete search history.

(56) References Cited

U.S. PATENT DOCUMENTS 1,958,308 A * 5/1934 George ..... 451/556
2,280,767 A * 4/1942 Ferragano ..... 451/522
2,645,066 A * 7/1953 Andrews ..... 451/555
3,644,993 A * 2/1972 Chupp ..... 451/557
4,114,321 A * 9/1978 Jarvis et al. ..... 451/557
5,163,251 A * 11/1992 Lee ..... 451/555
5,505,656 A 4/1996 Moore
5,520,574 A 5/1996 Wilson
5,667,434 A 9/1997 Prusaitis et al.
6,149,662 A 11/2000 Pugliesi et al.
6,971,949 B2 12/2005 Gleason
7,217,126 B2 5/2007 Sommers et al.

* cited by examiner

*Primary Examiner* — Hadi Shakeri

(57) ABSTRACT

A sharpening device for sharpening operative instrumentation having a gripping handle 4 and an acutely angled receptacle support 6, both of which form a radiated palmer contour 8, and both of which have flattened self balancing table rest 10 terminations. The hone receptacle 6 has an attached offset rectilinear container or whet-stone receptacle 12 with guard walls 16 that extend above a contained whet-stone 14. The instrument entry channel 18 is a shorter wall that allows full usage of the whet-stone surface without forcibly influencing sharpening angulations due to an excessively high wall. The offset receptacle support 6 and whet-stone receptacle 12 create two overhangs or a vertical locking rest 20 and a horizontal locking 22 rest that engage with a table. The locking rests coupled with the angled handle 4 receptacle support 6 and resultant palmer contour 8 permit two ergonomic holding positions that allow for both vertical and horizontal honing orientations.

11 Claims, 16 Drawing Sheets

WHET-STONE RECEPTACLE AND HAND GUARD

CROSS REFERENCE TO RELATED APPLICATIONS

This Application claims the benefit of Provisional Patent Application Ser. No. 61/065,599, filed Feb. 13, 2008 by the Present Inventors

FEDERALLY SPONSORED RESEARCH

Not Applicable

SEQUENCE LISTING OR PROGRAM

Not Applicable

BACKGROUND

1. Field of Invention

This invention applies to the field of instrument sharpening specifically to allow for the ergonomic honing of hand held instruments such as those used in dentistry, to include but not limited to those used in the scaling and scraping of the coronal and root areas of teeth 2. Prior Art Dental prophylaxis, which includes the scraping of accumulated tartar, or calcified deposits on the coronal and root surfaces of teeth, relies on specific instrumentation to engage the inter-proximal, or between the teeth surfaces. These instruments typically have tapered, beveled, pointed ends to access these tight spaces. Also, to dislodge the tartar, which tenaciously adheres to the tooth surface, it is imperative that the beveled ends be finely honed and sharp. Due to the inherent hardness of the tartar, and in particular the enamel surfaces of the teeth, the instruments quickly dull upon repetitive scraping. It is incumbent upon the clinician to maintain a sharpened edge to facilitate complete tartar removal with minimal ergonomic effort. Maintaining a properly honed edge requires frequent sharpening. To achieve this, the clinician resorts to a sharpening or Arkansas-type stone. Typically the stone is grasped between the thumb and index finger of the hand opposite the instrument holding one. The scraping motion employed requires that the fingers holding the stone must be specifically placed as to present the proper orientation of the stone's surface to the instrument's head. Furthermore, the finger grasp must be adequate enough to resist stone displacement and care must be taken to protect the holding fingers and hand from being pierced. The WHET-STONE RECEPTACLE AND HAND GUARD presents as a device to grasp the stone which is now shielded to prevent inadvertent self-sticking while being able to apply the instrument head for sharpening in an ergonomic manner. When grasped, the WHET-STONE RECEPTACLE AND HAND GUARD places the level of the sharpening surface above the fingers and the knuckles such that when the instrument head is swiped on the sharpening surface, it is directed away from the hand, thereby eliminating the potential to stick oneself. The WHET-STONE RECEPTACLE AND HAND GUARD therefore provides the clinician with an added level of safety from self-sticking with instruments contaminated with pathogens derived from the oral tissues of a patient.

U.S. Pat. No. 5,505,656 to Moore, Steven B., Apr. 9, 1996, presents an apparatus for manually sharpening instruments in which the honing stone is retained perpendicularly within the holding member. The holding member does not protect the hand and fingers that secure it from inadvertent misdirection of the instrument head during the swiping phase. Further, the configuration of the holding member requires a hand and finger grasping position that creates ergonomic stresses.

U.S. Pat. No. 5,520,574 to Wilson, Roselyn, May 28, 1996, presents an instrument sharpening device comprising a rectangular and elongate wedge-shaped ceramic stone. It is designed to allow passage of the instrument head to be sharpened over many aspects of the stone's surface. This stone possess no restrictive walls or deflection barriers thereby predisposing the operator to inadvertent finger or hand assaults from a misdirected motion.

U.S. Pat. No. 5,667,434 to Prusaitis, John H., and Prusaitis, Timothy J., Sep. 16, 1997, presents a device which has a vertical supporting member affixed to a horizontal base member. The sharpening stone is attached to the vertical supporting member such that the grasping hand is remote from the sharpening area. However, the apparatus must be stabilized on a stationary horizontal surface during its usage which limits its portability and employment as a hand-held device.

U.S. Pat. No. 6,149,662 to Pugliese, Robert B., and Cucinella, Salvatore, Nov. 21, 2000, presents a hand held sharpening device in which the grasping hand is remote from the sharpening area. However, the device is configured to sharpen scissors, and does not permit for the engagement of operative instruments such as dental scalers and curettes. Specifically, the patent declares itself to be a scissor sharpener.

U.S. Pat. No. 6,971,949 to Gleason, Robert, Dec. 6, 2005, presents as a sharpening guide for dental instruments. Its primary focus is to maintain a specified orientation between the instrument head and the sharpening surface. In itself, it possesses no sharpening medium. Also, it provides no ergonomic design for grasping. Further, it provides no specific means to protect the grasping hand and fingers from inadvertent misdirected instrument swipes.

U.S. Pat. No. 7,217,126 to Sommers, Corey, et al, May 15, 2007, presents specifically as a hand held dental mirror, with a sharpening stone attached to the gripping shaft of the mirror. This configuration does have ergonomic limitations. Further, it provides no protection to the gripping hand from inadvertent misdirected instrument swipes.

Objects and Advantages

Accordingly, several advantages of the present patent application of Brian D. Viscomi and Howard S. Glazer for the WHET-STONE RECEPTACLE AND HAND GUARD are:

a. A sharpening stone to hone the cutting edges of instruments.
b. Ergonomically designed for comfortable, secure grasping.
c. Protectively encased stone as to prevent self-sticking during usage.
d. Lessens the chance of acquiring unwanted pathogens.
e. Withstands the rigors of autoclaving for infection control.
f. Reduces hand and finger stresses associated with carpal tunnel syndrome.
g. Allows for multiple hand and finger positions for maximum comfort.
h. Assumes multiple orientations to best access instrument's cutting surface.

SUMMARY OF THE INVENTION

It is thus the object of this invention to provide an operator with a device to sharpen operative instruments.

Also, this invention is designed to protect the operator's hand and fingers from injury resulting from inadvertent misdirected instrument swipes.

It is a further aim of this invention to provide the operator with an ergonomic handle to lessen muscle and tendon stress.

In addition, this invention may be oriented in a variety of positions to allow for the most favorable position of the instrument head to the sharpening surface.

DRAWINGS—FIGURES

Figure 10A:
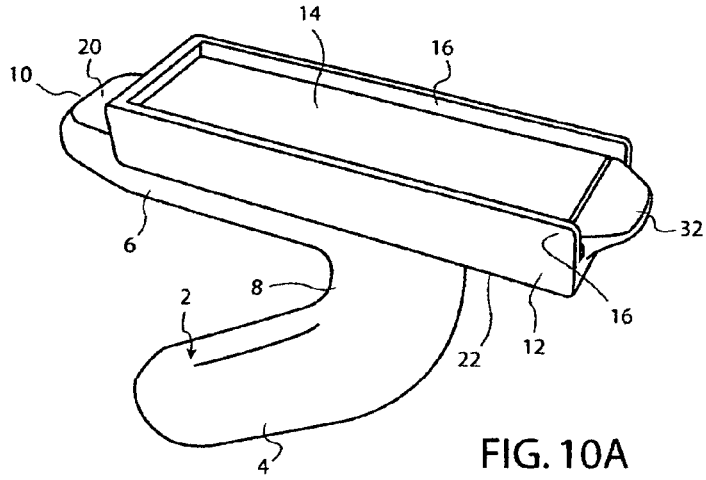
Figure 10B:
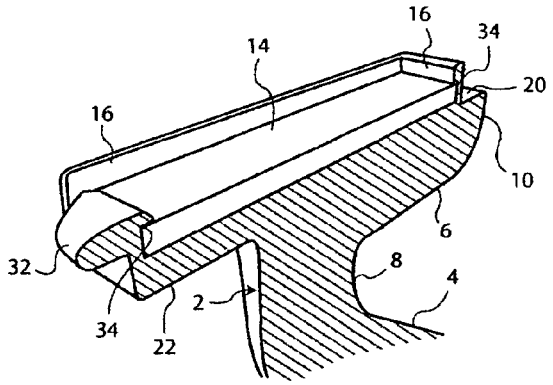
Figure 10C:
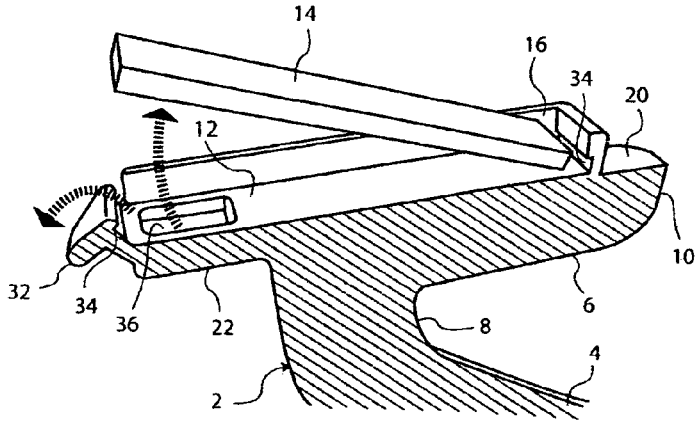

FIGS. 10A to 10*c* show various dimensional views of an alternative safety hone embodiment having a whet-stone securing lever to allow for stone removal.

Figure 11A:
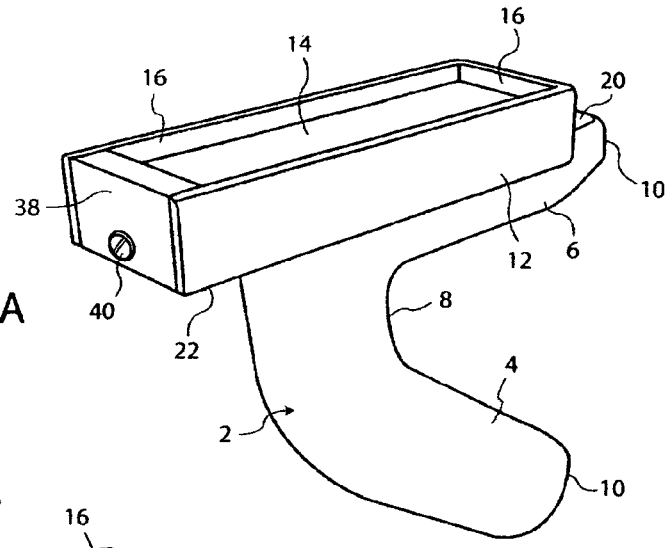
Figure 11B:
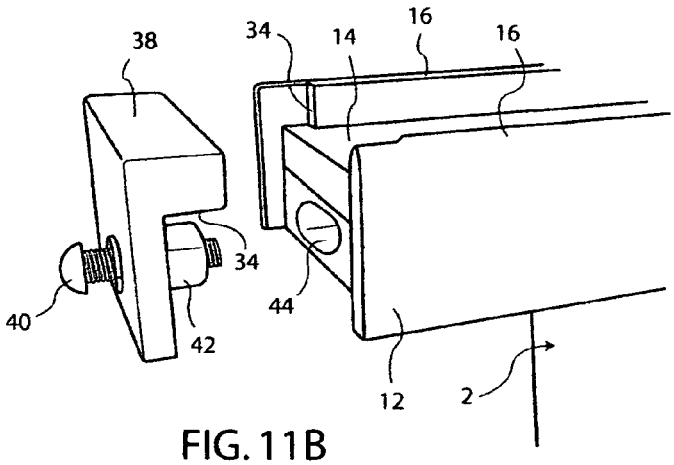
Figure 11C:
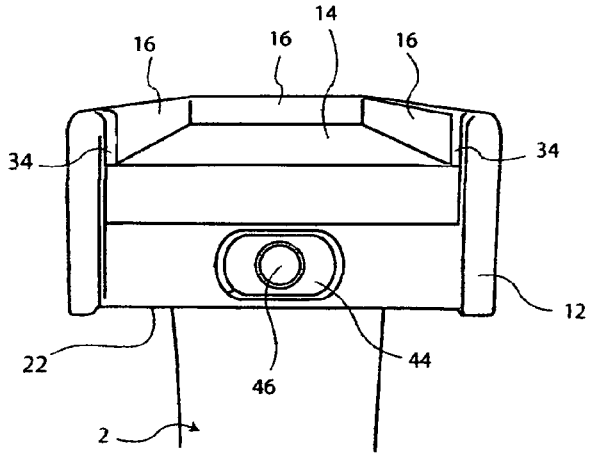

FIGS. 11A to 11C show various dimensional views of an alternative safety hone embodiment having a removable securing cap to allow for stone removal.

Figure 12A:
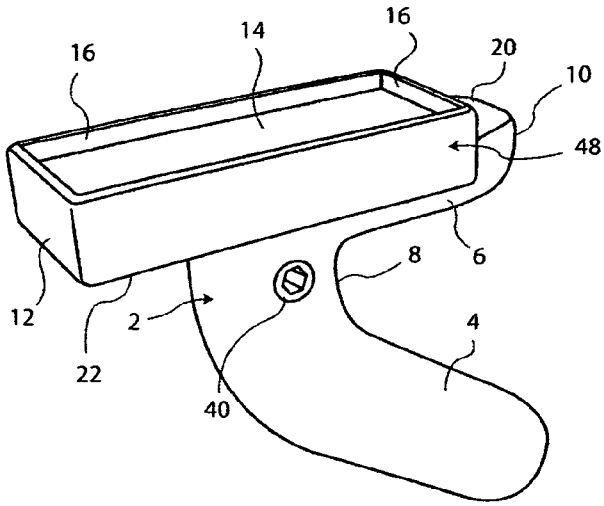
Figure 12B:
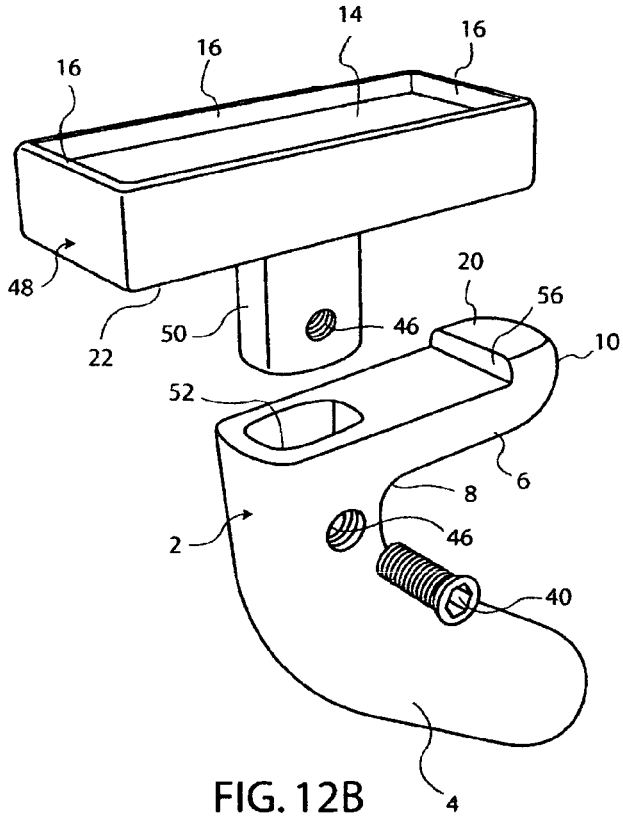
Figure 12C:
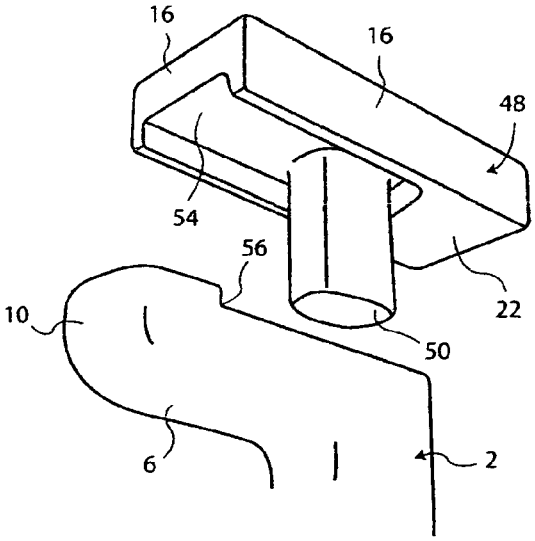

FIGS. 12A to 12C show various dimensional views of an alternative safety hone embodiment having a docking whet-stone receptacle to permit interchangeable honing options.

Figure 13A:
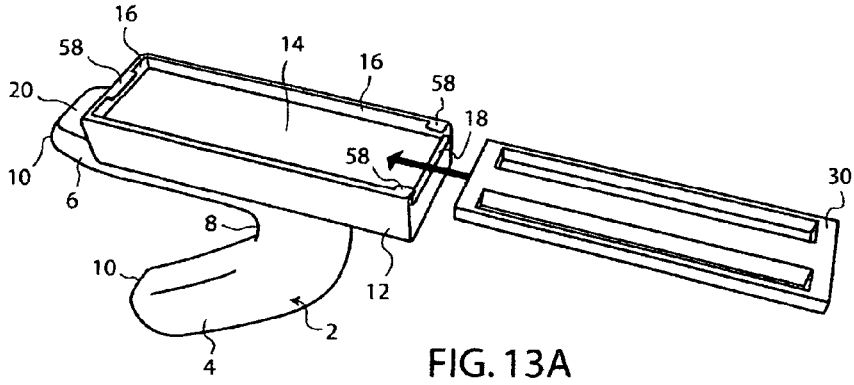
Figure 13B:
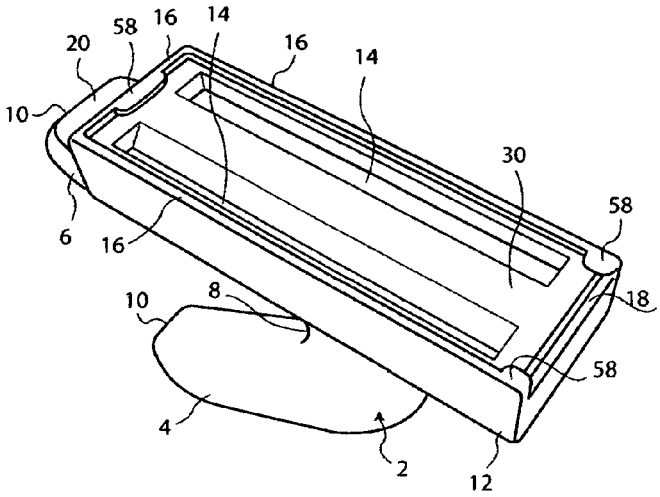
Figure 13C:
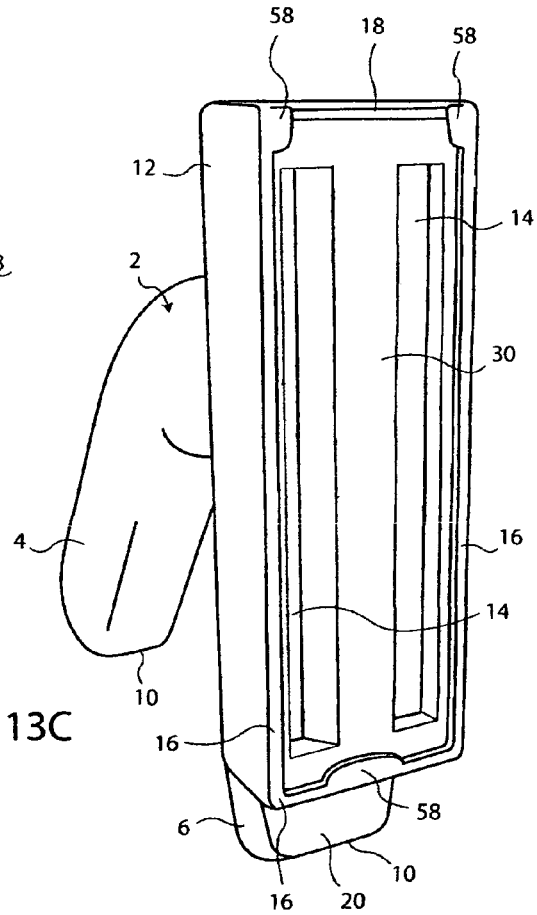

FIGS. 13A to 13C show various dimensional views of an alternative safety hone embodiment having guide securing extrusions to securely hold a sharpening guide during horizontal and vertical operation.

FIGS. 14A to 14E show various views of a safety hone having a pivoting whetstone receptacle that permits variably customized whet-stone angulations.

Figure 15A:
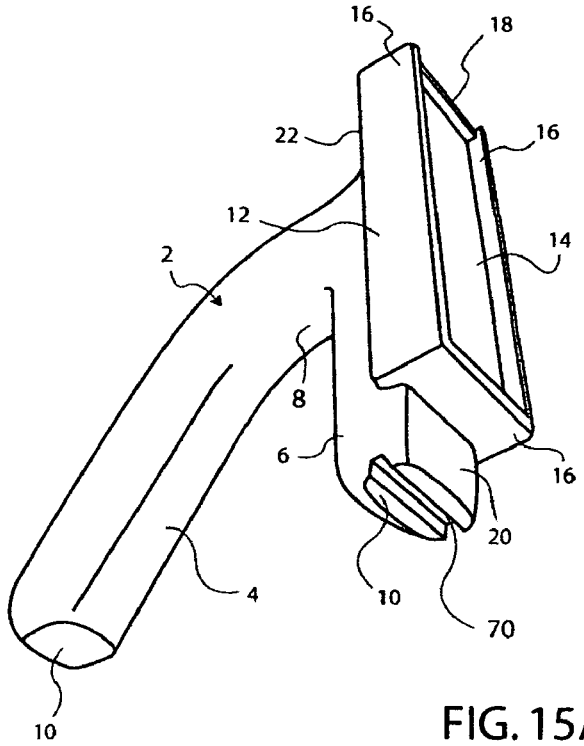
Figure 15B:
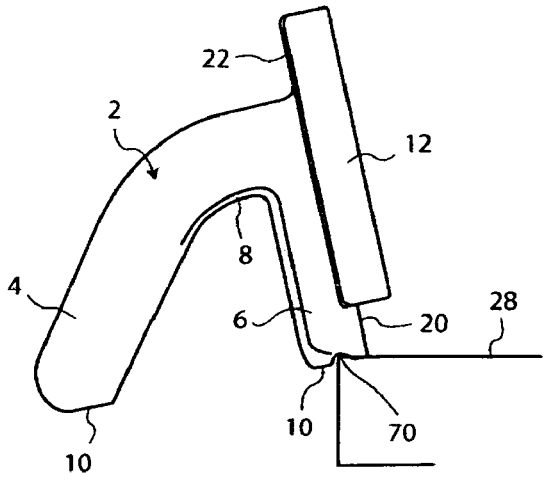
Figure 15C:
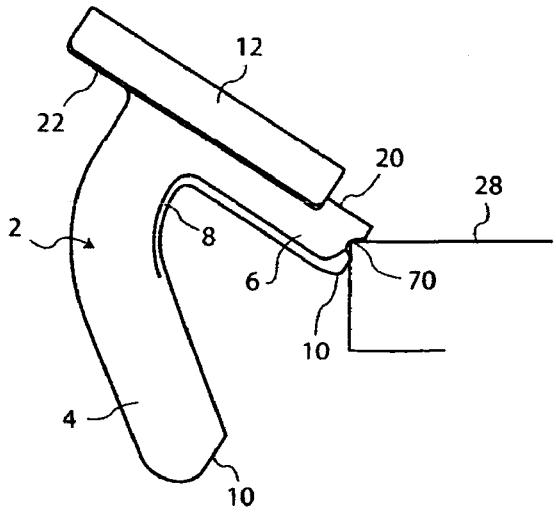

FIGS. 15A to 15C show a hone having the addition of a free pivot rest integrated into the hone support's table rest.

Figure 16:
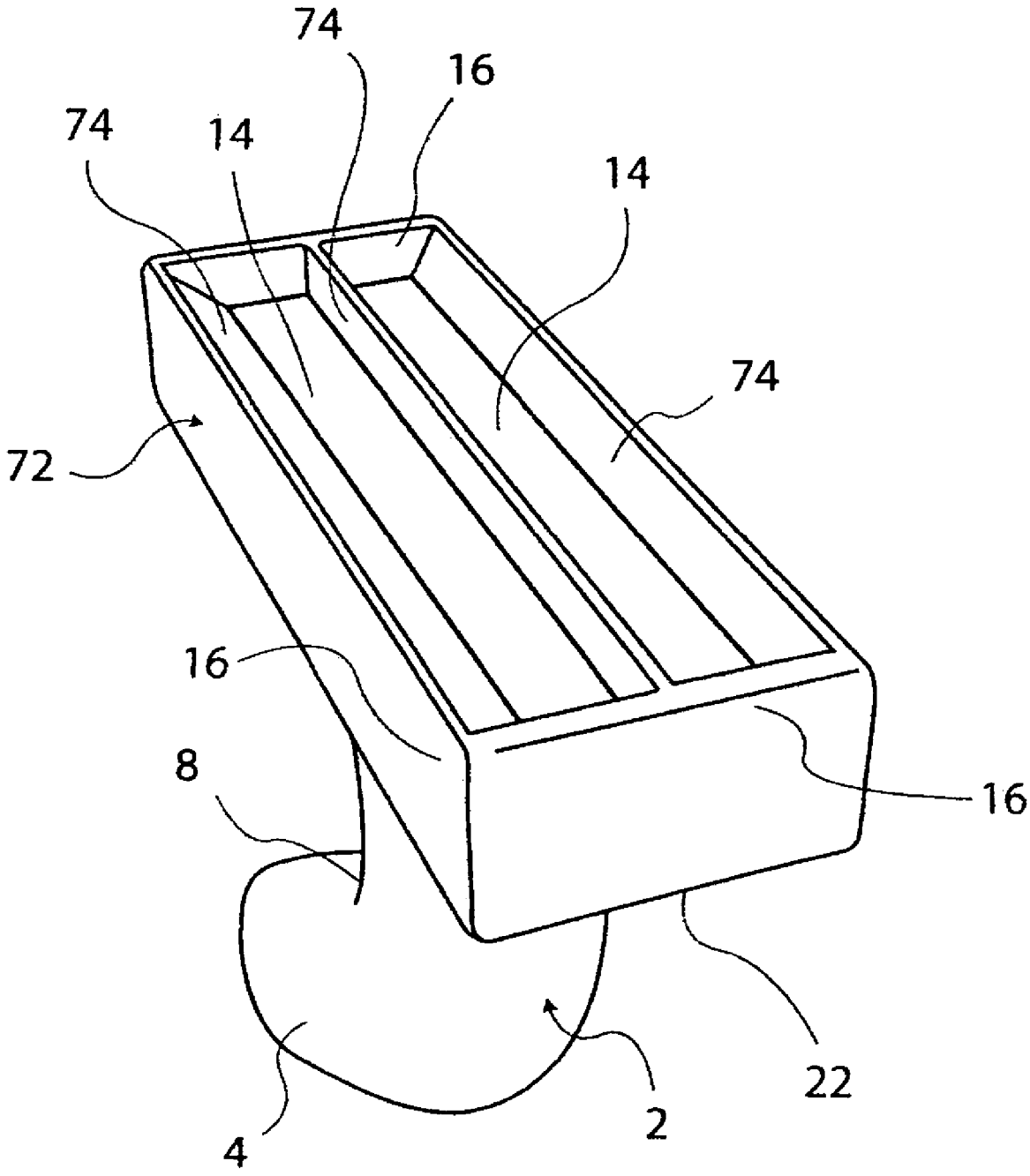

FIG. 16 shows a hone that has a whet-stone receptacle with integrated guide.

DRAWINGS—REFERENCE NUMERALS

2. Instrument hone
4. Gripping Handle
6. Receptacle support
8. Palmer gripping contour
10. Table rest
12. Whet-stone receptacle
14. Whet-stone
16. Guard wall
18. Instrument entry channel
20. Vertical locking rest
22. Horizontal locking rest
24. Operator
26. Instrument
28. Supporting surface
30. Sharpening guide
32. Whet-stone securing lever
34. Securing overhang
36. Stone removal aperture
38. Securing cap
40. Securing screw
42. Cap securing extrusion
44. Cap securing recess
46. Screw hole
48. Docking whet-stone receptacle
50. Receptacle docking extrusion
52. Handle docking recess
54. Receptacle docking channel
56. Docking abutment
58. Guide holding extrusions
60. Pivoting whet-stone receptacle
62. Receptacle pivot extension
64. Pivot recess
66. Pivot aperture
68. Pivot screw
70. Free pivot angle
72. Whet-stone receptacle with integrated guide
74. Guide wall

DETAILED DESCRIPTION—PREFERRED EMBODIMENT FIGS. 1A-1E 2A, 2B, 6A, 6B

Figure 1A:
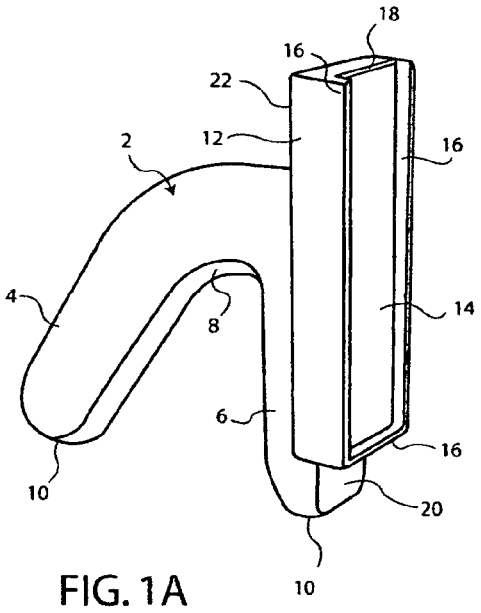
FIGS. 1A to 1E show various views dimensional and orthographical of a variably ergonomic safety hones' preferred embodiment.
Figure 1B:
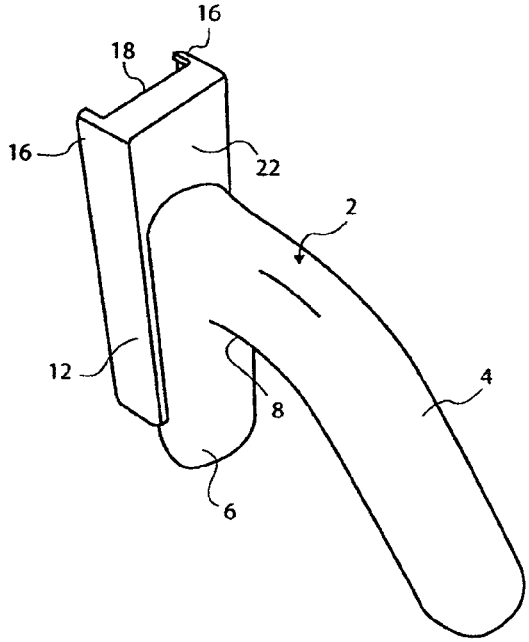
Figure 1C:
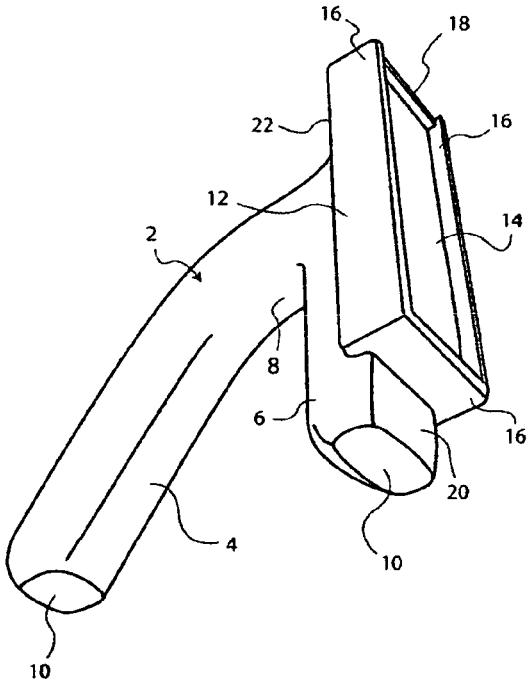
Figure 1D:
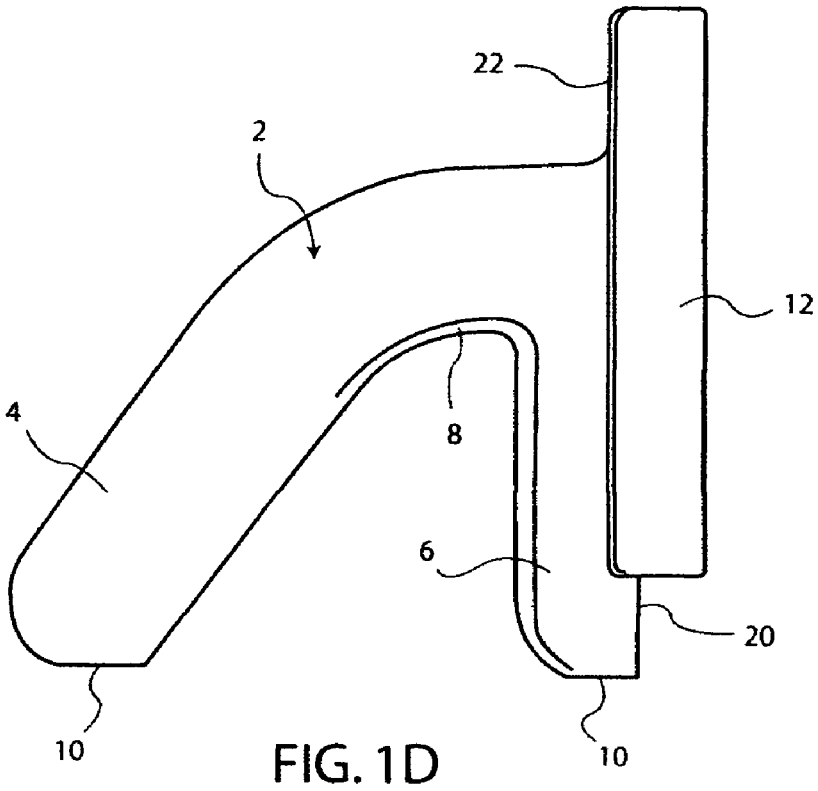
Figure 1E:
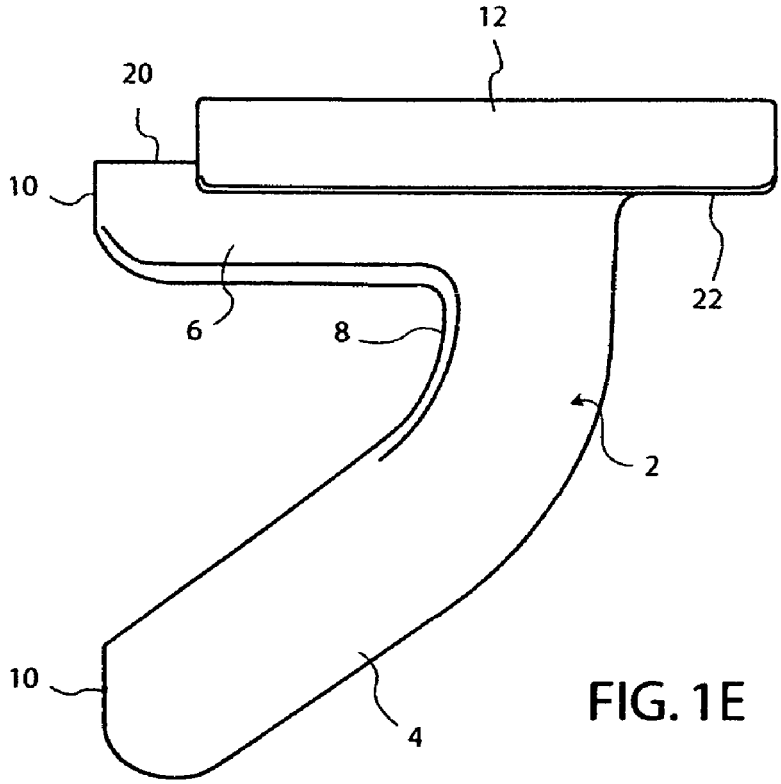

A preferred embodiment of the variably ergonomic instrument hone 2 of present is illustrated in FIGS. 1A to 1E. FIG. 1A shows an anterior dimensional view of the instrument hone. FIG. 1B shows a superior posterior dimensional view of the safety hone. FIG. 1C shows an inferior anterior dimensional view of the instrument hone 2. FIG. 1D shows a lateral orthographic view in a vertical honing orientation. FIG. 1E shows a lateral orthographic view in a horizontal honing orientation. The hone 2 has a somewhat asymmetrical "V" shaped gripping body which is comprised of a mildly angled cylindrical extension or handle 4 with an acutely angled column-like structure or receptacle support 6. Attached to the receptacle support 6 is a rectilinear box-like volume or whet-stone receptacle 12 containing an abrasive member or whet-stone 14.

Figure 2A:
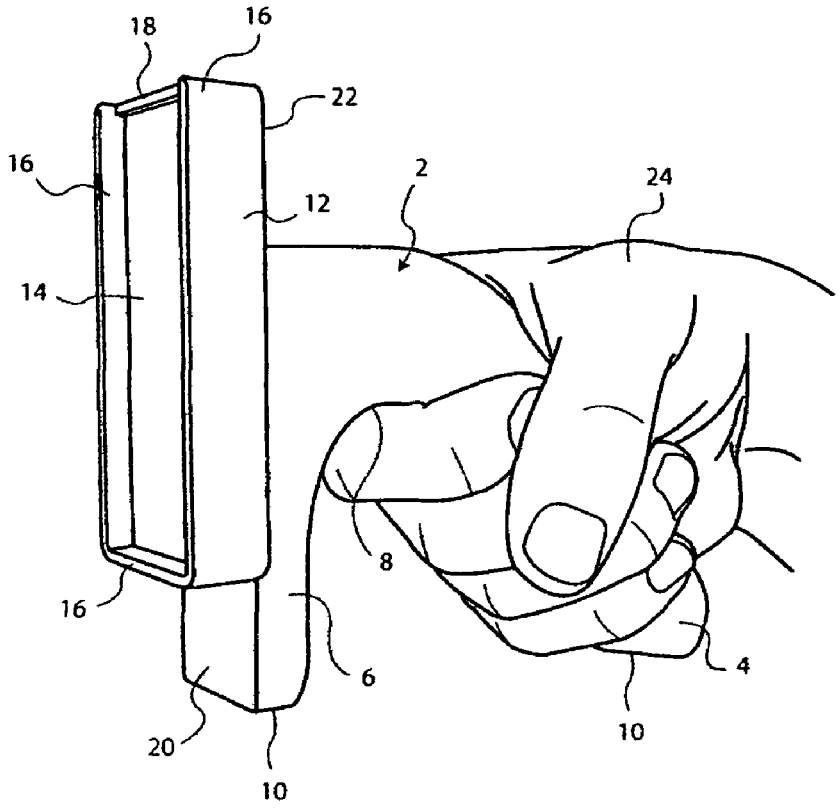
FIGS. 2A to 2B show anterior and posterior dimensional views of an operator holding an instrument hone in a vertical sharpening orientation.
Figure 2B:
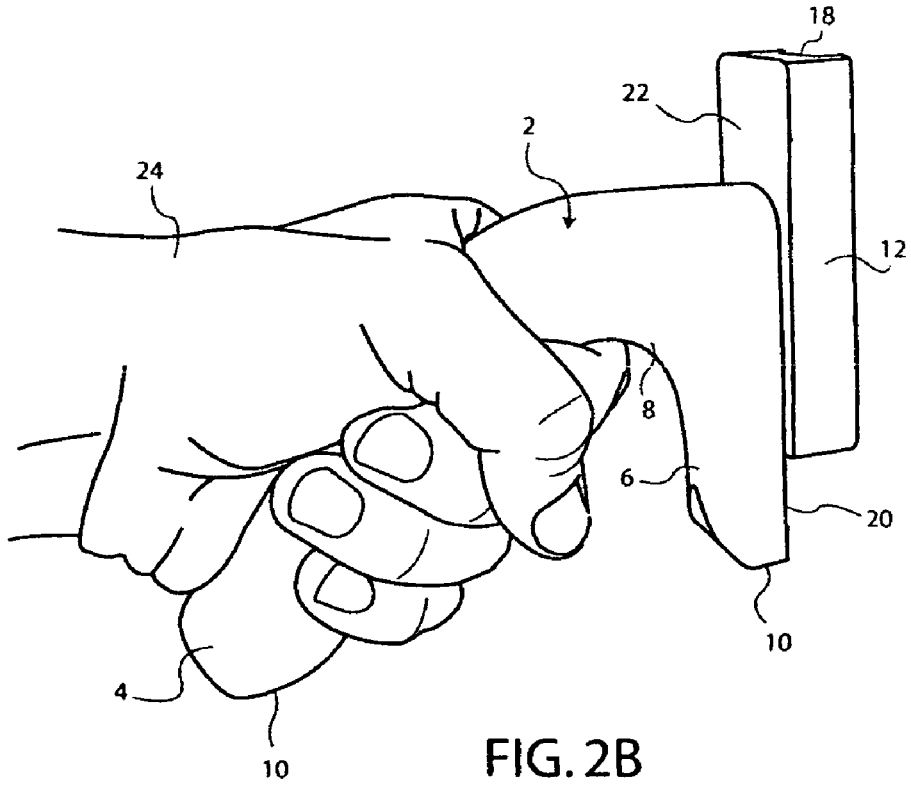
Figure 3:
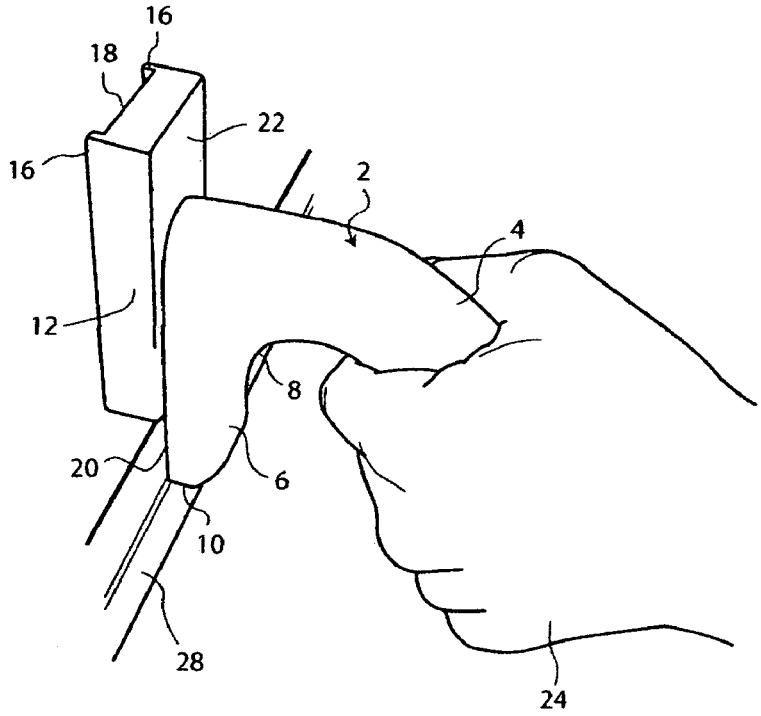
FIG. 3 shows a safety hone engaged with a table surface via a vertical locking rest.
Figure 6A:
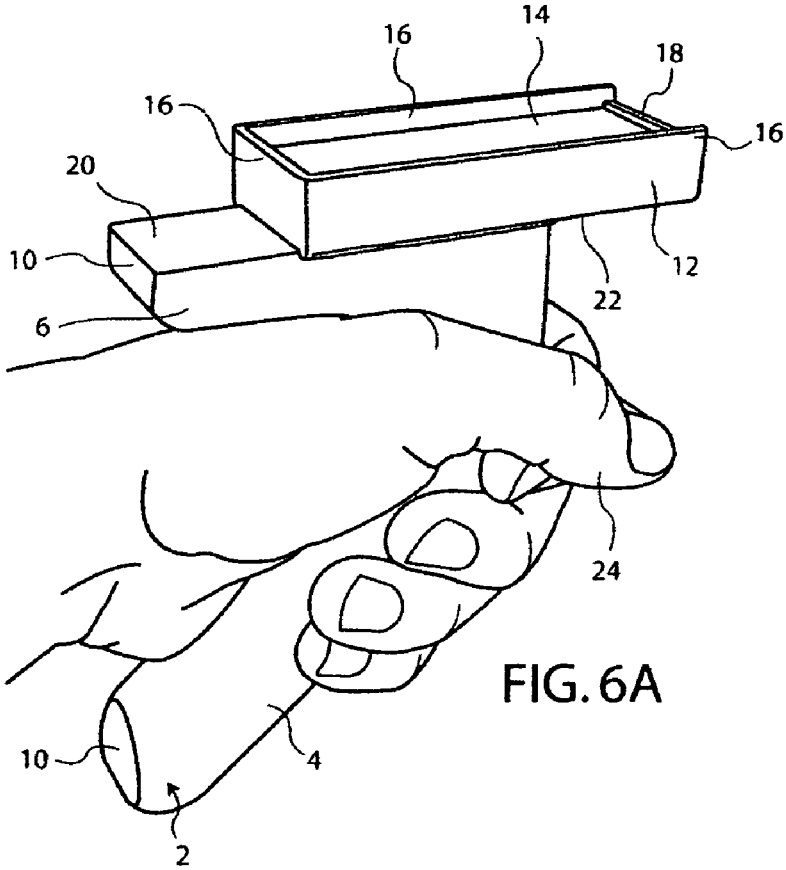
FIGS. 6A to 6B show anterior and posterior dimensional views of an operator holding a safety hone in a horizontal sharpening orientation.
Figure 6B:
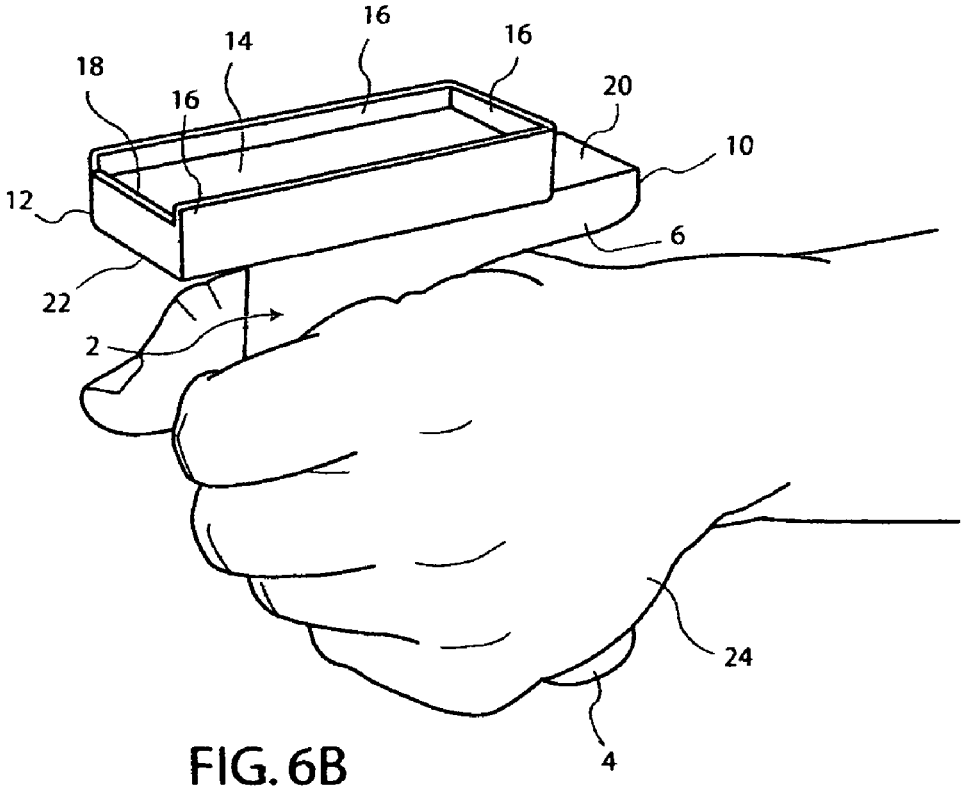

The convergence or vertex of handle 4 and hone receptacle support 6 desirably form a 45 to 50 degree angle. This convergence is characterized with a gently curved radius, or palmer gripping contour 8. The contour 8 is optimally designed to fit into operator's hand, specifically the region between the index finger and thumb. This specific "V" shaped configuration functions to permit a dual ergonomic capability. The first ergonomic position allows the instrument hone 2 to be held in a similar fashion to a pistol (FIGS. 1D, 2A and 2B). Holding the handle 4 in this manner places the hone in a vertical orientation (FIG. 1D vertical orientation). The second ergonomic position allows the hone 2 to be held in a horizontal orientation. This is achieved when an operator places the palmer contour 8 between the index finger and thumb while grasping the handle 4 (FIGS. 1E 6A, 6B).

Formed onto the ends of the handle 4 and receptacle support 6 are flat terminations or table rests 10 (FIG. 1C). The table rests 10 are formed in planar or axial alignment with each other for free standing placement onto a flat supporting surface. This is intended to facilitate stable balance for usage on a table top surface. Note, when supported on its rests 10 the hones' whet-stone 14 assumes vertical honing orientation that is perpendicular to the resting surface.

Arising from the receptacle support 6 is a box-like volume or whet-stone receptacle 12. The receptacle 12 is rectilinear and has an offset relationship to the receptacle support 6. The whet-stone receptacle 12 has base foundation or floor and four walls to form a containing volume. This volume is desirably sized to hold a 1.25" by 3.25" by 0.25" whet-stone 14. Furthermore, the whet-stone receptacle 12 walls are desirably high to extend a distance above the whet-stones 14 honing surface. These extended or guard walls 16 serve a dual function with relation to safety and honing efficiency. Firstly, they contain the honing motion during operation to eliminate potential injury from errant honing. Secondly, the walls 16 may serve as an abutment or guide rest that allows an instrument to be swept over the whet-stone 14 in a predictable path. At one end of the whet-stone receptacle 12 is a slightly shorter guard wall 16 that creates a gap or instrument engagement channel 18. This channel 18 ensures that a fixed or mechanically limited honing angle will not result or be imposed by an excessively high guard wall 16. This allows a user to sweep an instrument along the entire whet-stone 14 surface without interference from a wall 16.

The whet-stone receptacle 12 offset relationship with the receptacle support 6 results in two distinct overhangs to interlock with a supporting surface. These two overhangs, or vertical locking rest 20 and horizontal locking rest 22 serve as hone resting stabilizers to mechanically stabilize the whet-stone. Engaging the vertical locking 20 with a table edge positions the whet-stone 14 in a vertical orientation. Conversely, engaging the horizontal locking rest 22 with a table edge positions the whet-stone 14 in a horizontal orientation.

The instrument hones' 2 handle 4 receptacle support 6 and whetstone receptacle 12 may be made as one piece through a single injection mold. It may be made of plastic or any other suitable synthetic. Furthermore, it may also be fabricated from wood or suitable metal or alloy by molding machining or die stamping. The whet-stone may be comprised of presently available varieties. Furthermore, the whet-stone may be bonded to the whet-stone housing's interior with glues or adhesives, or may be incorporated into the receptacle support during the injection molding process.

Alternative Embodiments

There are various possibilities with regard to the variably ergonomic instrument hone 2. Some of these embodiments permit the removal of a whet-stone for replacement or sterilization purposes. Other embodiments have integrated abilities to securely hold independent sharpening guides. Lastly, pivoted designs permit a high degree of operator customization.

For example, FIGS. 10A to 10C show a hone 2 having a flexible whet-stone securing lever 32. This lever 32 can be flexed to disengage a securing over hang 34 from the stone 14 thereby allowing for its removal from the whet-stone receptacle 12. Note, a stone removal aperture 36 integrated into the floor of the whetstone receptacle 12 can aid dislodgement by using a finger or other suitable instrument.

FIGS. 11A to 11C show a hone having a removable securing cap 38. The cap can be both attached and removed from whet-stone receptacles 12 end via a securing screw 40. The cap 38 also has a cap securing extrusion 42 which docks with the whet-stone receptacle 12 via an opening or cap securing recess 44. The cap securing extrusions 42 shape is intended to create additional interlocking stability. Located within the cap docking recess 44 is a smaller threaded aperture or screw hole 46 that accepts the securing screw 40.

FIGS. 12A to 12C show a hone 2 that has a removable or docking whetstone receptacle 48. This permits a user to easily interchange a whet-stone 14 (if they desire a specific honing coarseness) by simply docking a desired whet-stone receptacle 48. Additionally, this facilitates sterilization by simply autoclaving a single piece. The docking whet-stone receptacle 48 has an extension or receptacle docking extrusion 50 that is designed to insert within a handles 4 handle docking recess 52. Both the receptacle docking extrusion 50 and the handle docking recess 52 have threaded screw holes 46 that correlate when the two are fully docked. This permits a securing screw 40 to traverse both and create a mechanically secure union. To further enhance a stable operation, the docking whet-stone-receptacle 48 features a recessed receptacle docking channel 54 on its underside. This underside recessed portion is designed to interface with a receptacle support 6 and docking abutment 56.

FIGS. 13A to 13C show a hone 2 having three protrusions or guide holding extrusions 58 originating from superior aspects of the guard walls 16. These permit an independent guide 30 to be inserted through the instrument entry channel 18. As it is being inserted, the guide 30 remains below the holding extrusions 58. This serves to contain the guide 30 so that is may be utilized in a vertical orientation (it will not dislodge).

Figure 14A:
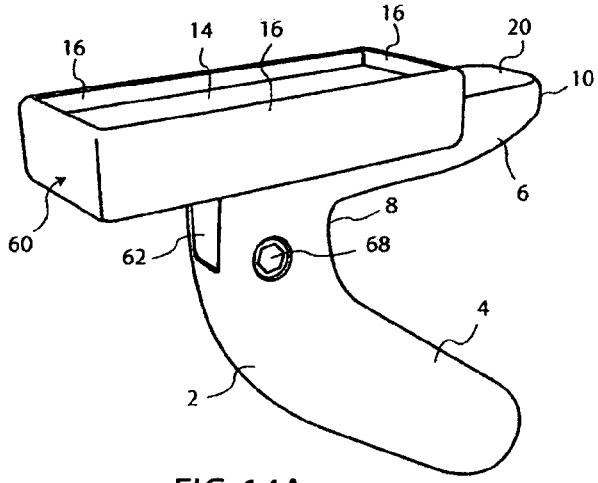
Figure 14B:
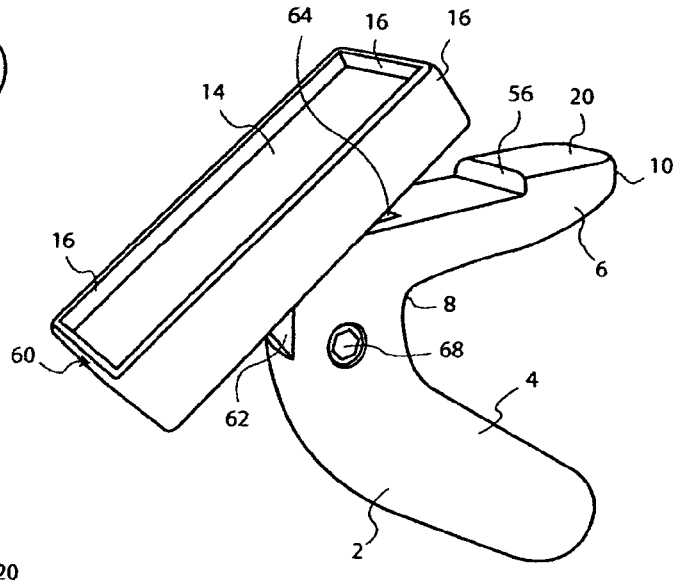
Figure 14C:
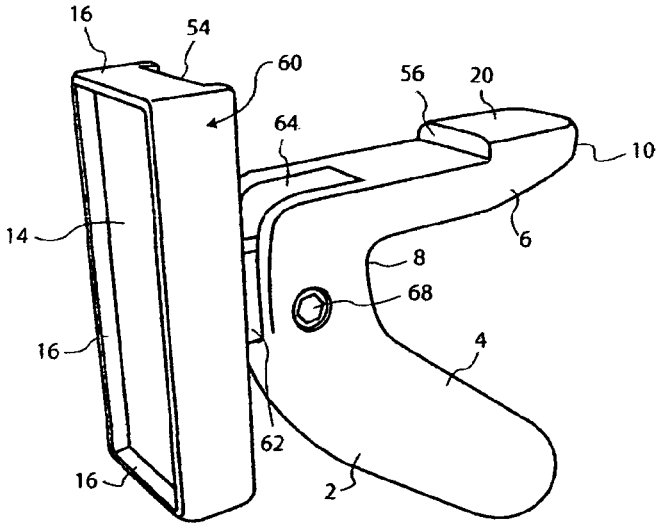
Figure 14D:
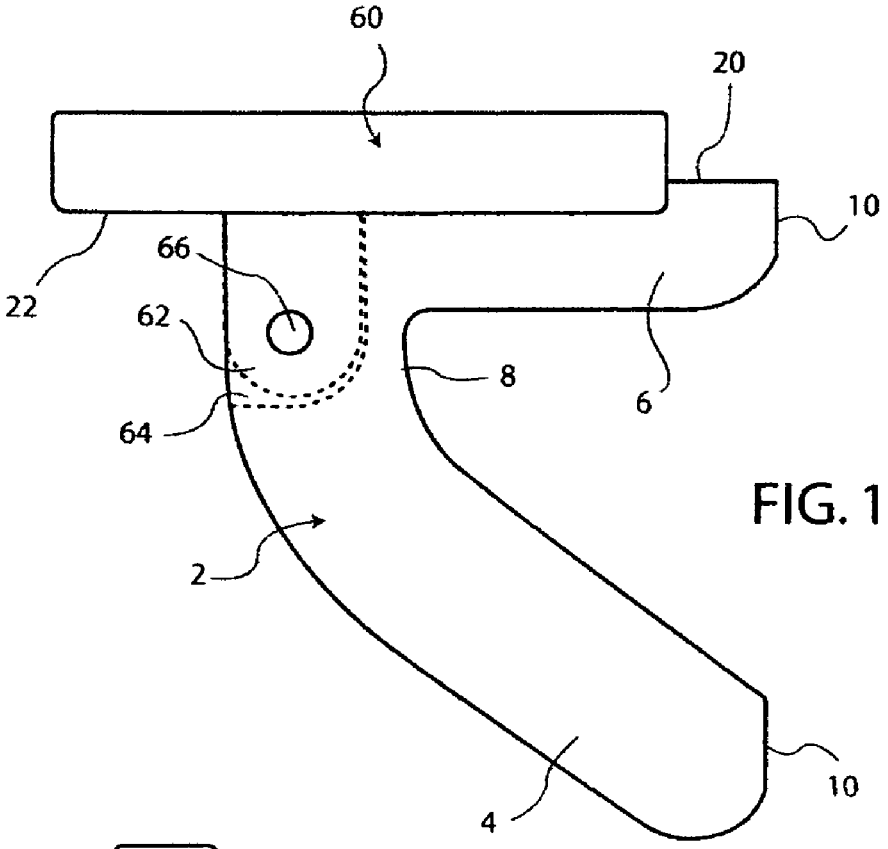
Figure 14E:
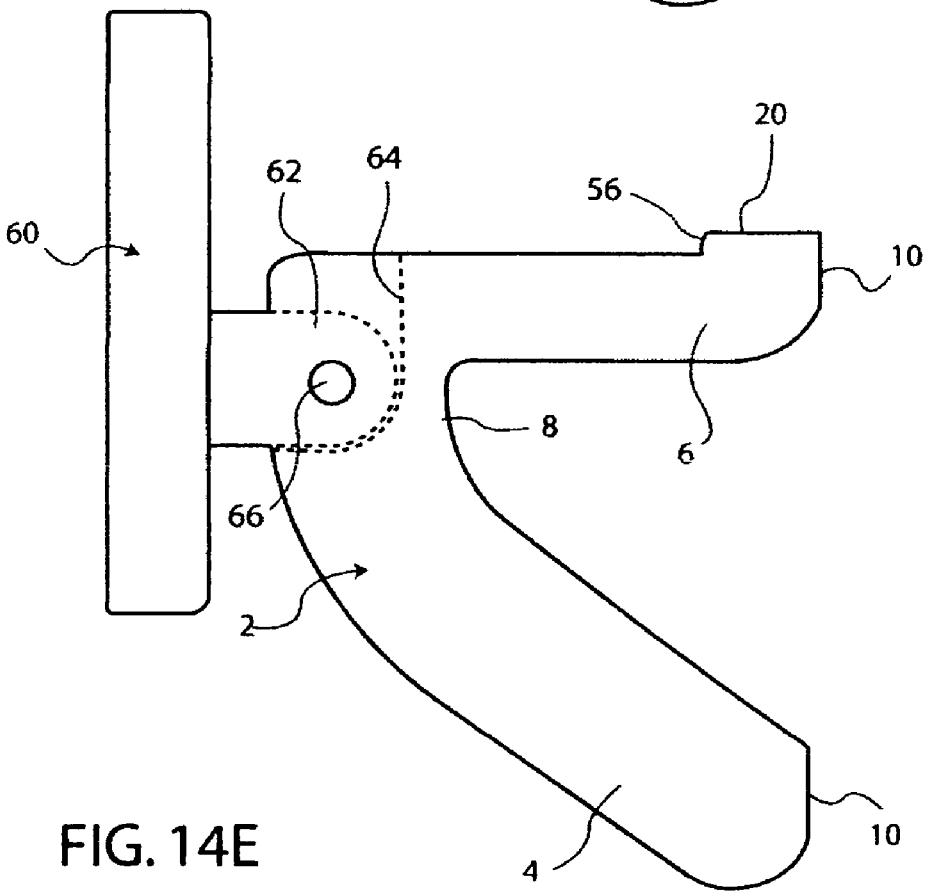

FIGS. 14A to 14E show various views of a hone 2 having a pivoting whet-stone receptacle 60 that permits customized user angulations. The whet-stone receptacle 60 has and extruding receptacle pivot extension 62 that originates from its inferior aspect (FIGS. 14D and 14E). At the pivot extensions 62 semicircular termination is an opening or pivot aperture 66. The pivot extension 62 and pivot aperture 66 are designed to interface with a channel or pivot recess 64. This recess 64 is formed into aspects of the handle 4 and hone support 6. The pivot recess has a aperture 66 or screw-hole 46 that correlates with the pivot aperture 66 when properly interfaced. This allows the pivoting whet-stone housing 60 to rotate along a pivoting screw 68 (FIGS. 14A and 14E). Subsequent tightening of the pivot screw 68 will ensure operational stability.

FIGS. 15A to 15C show a hone 2 having the addition of a free pivot angle 70 integrated into the hone support 6 table rest 10. Its design is optimized to interface with an edge or corner. Once engaged, the free pivot 70 angle serves as a pivot point to permit customized rotation.

FIG. 16 shows a hone 2 that has a whet-stone receptacle with integrated guide 72. This combines the independent guide 30 and integrates it with a whet-stone receptacle 12 to create a singular structure. Guide walls 74 may substitute for the standard safety walls 16.

Operation—FIGS. 2A-9

The manner of using the instrument hone with whet-stone receptacle and hand guard first depends on the honing preferences of the operator 24. The hone 2 offers both a horizontal honing capability and a vertical honing capability. For a vertical honing capability, an operator 24 first grabs the handle 4 as one would a revolver. When gripped correctly, the whet-stone 14 surface is in a perpendicular relationship to the ground plane (FIG. 2A anterior dimensional view and 2B Posterior dimensional view). Next, the operator 24 engages the vertical locking rest 20 with the edge of a supporting surface 28 (FIG. 3) to mechanical stabilize the hone 2.

Figure 4:
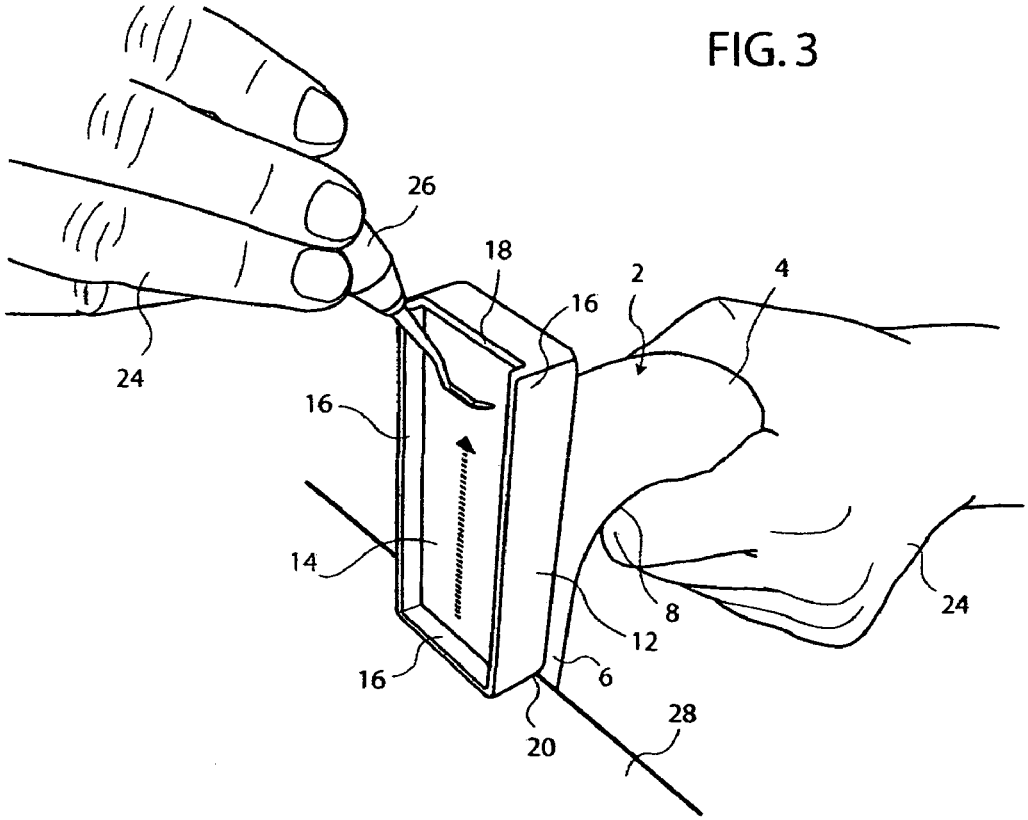
FIG. 4 shows an operator honing an instrument with vertical strokes.

When comfortable, the operator 24 now sweeps the operative portion of an instrument 26 along the whet-stone's 14 surface with a desired angle (FIG. 4). During the honing motion, the guard walls 16 function as a constraining perimeter during the honing operation. This prevents errant motion.

Figure 5:
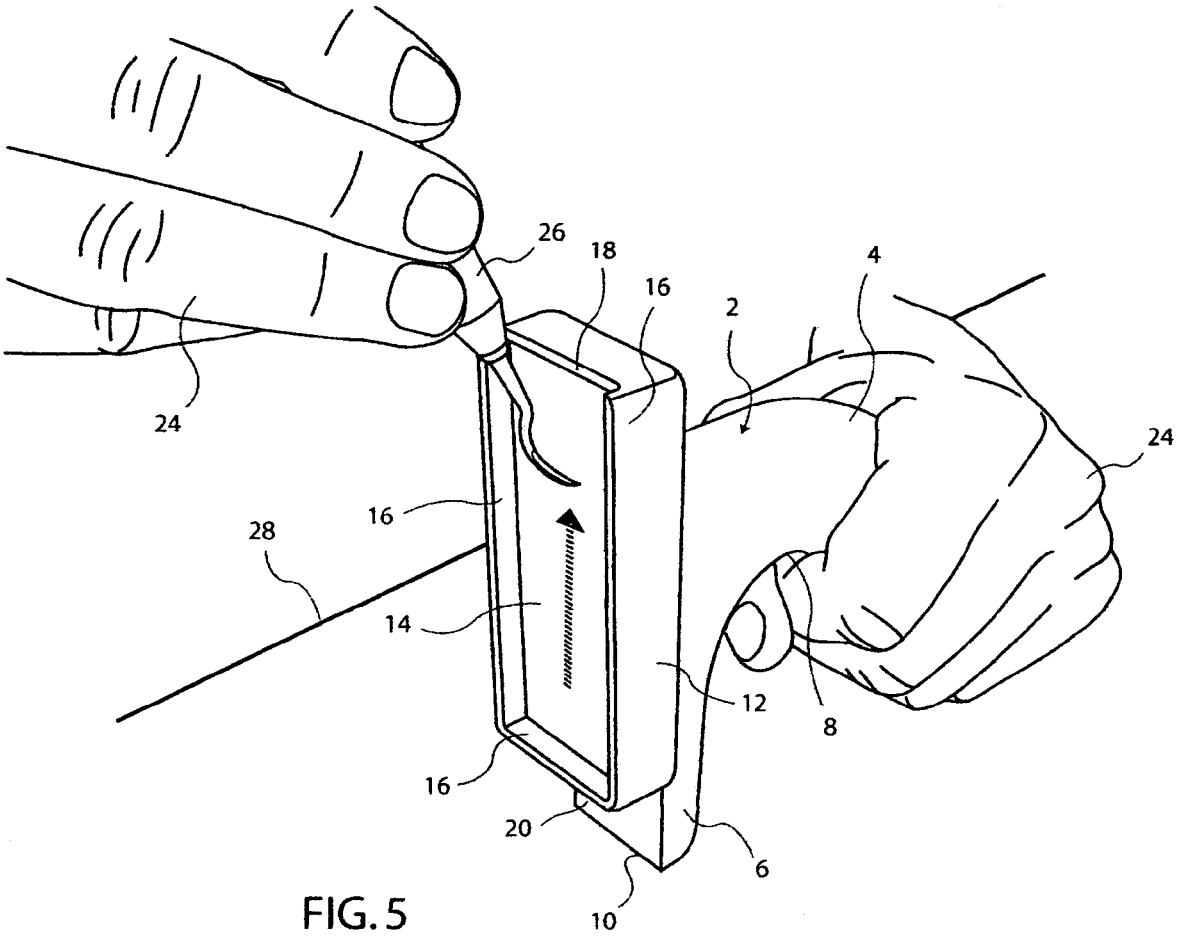
FIG. 5 shows a safety hone resting on the table surface while an operator vertically hones an instrument.

The guard walls 16 may also be utilized as an abutment to help guide the instrument 26 along a consistent path. This is repeated until the instrument 26 is sufficiently sharp. Note, an alternative vertical honing orientation is shown (FIG. 5). It relies on balancing the hone 2 on a surface rather than engaging the vertical locking rest 20 with a table edge. To do this, an operator first balances the hone 2 on the handle 4 and receptacle support 6 table supports 10. Next, the operator 24 grabs the handle 4 to stabilize the hone 2 for instrument 26 sharpening.

Figure 7A:
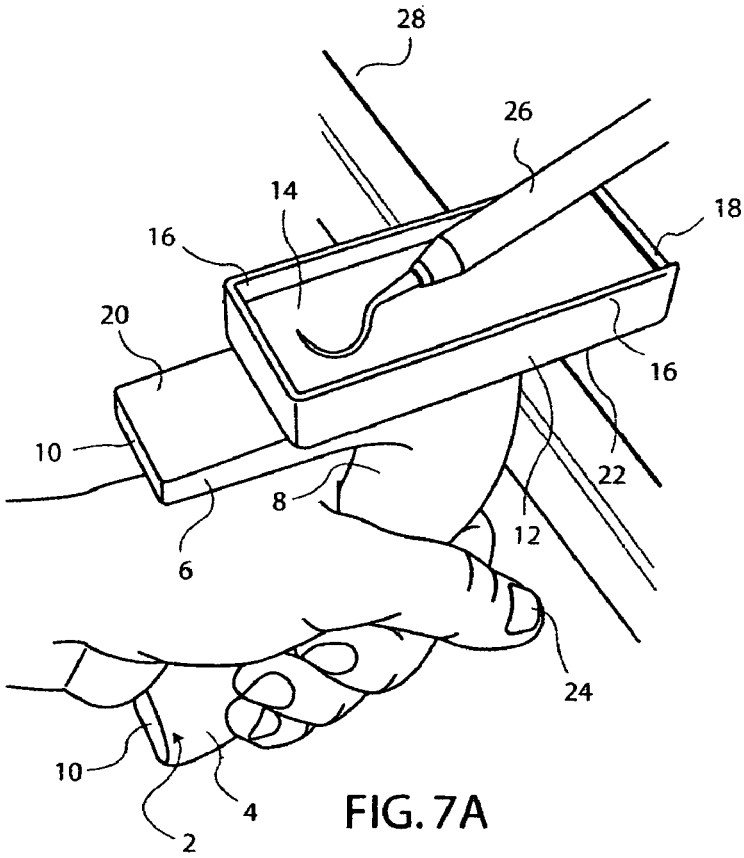
FIGS. 7A to 7B show a safety hone engaged with a table surface via a horizontal locking rest while the operator hones an instrument.
Figure 7B:
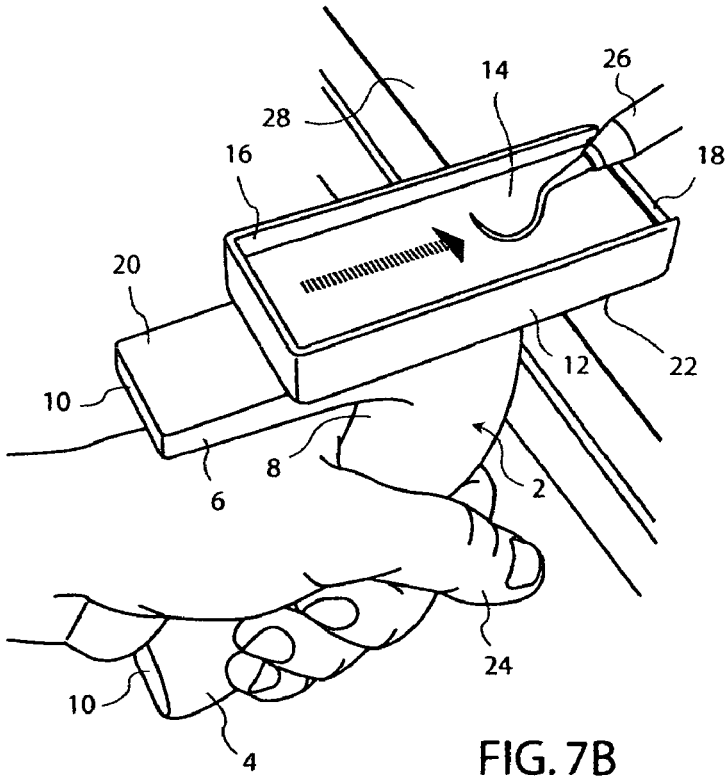
Figure 8A:
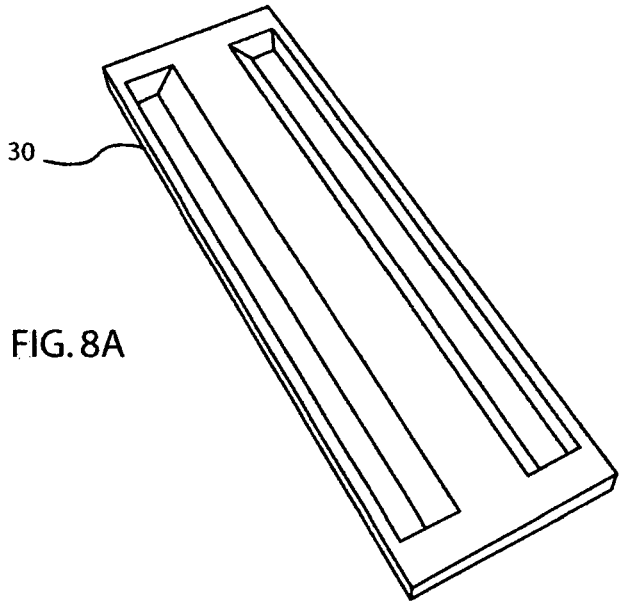
FIGS. 8A to 8B show a honing guide before and after it is placed within the safety hones whet-stone receptacle.
Figure 8B:
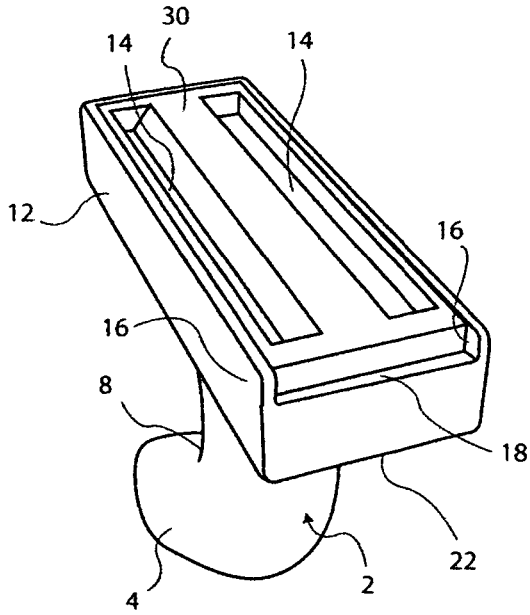
Figure 9:
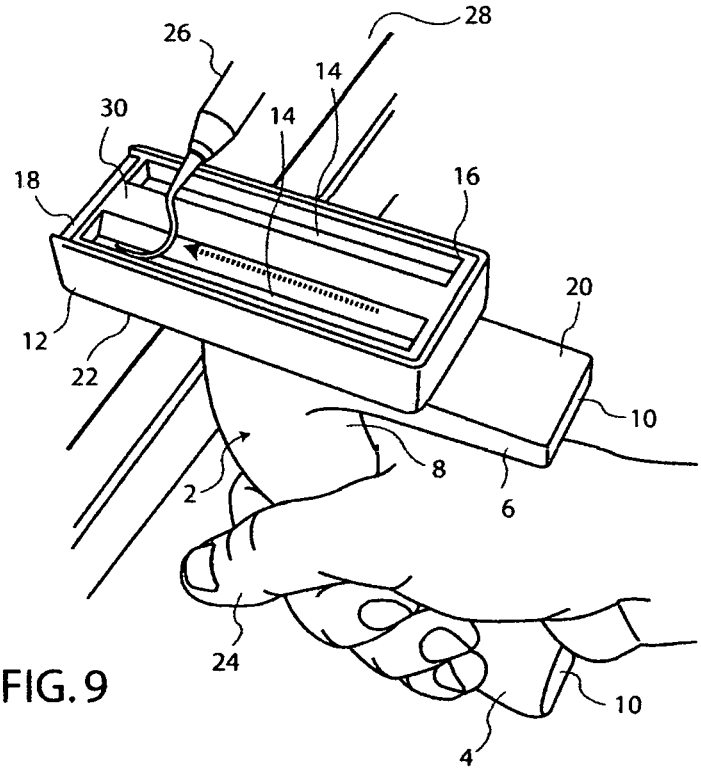
FIG. 9 shows an operator sharpening an instrument by running the operative portion along a beveled guide surface.

To hone an instrument in a horizontal position, an operator 24 grabs the hones 2 handle 4 so that the palmer contour 8 engages between the thumb and index finger (FIGS. 6A and 6B). When correctly positioned, the whetstone receptacle 12 and whetstone 14 have a generally parallel relationship to the ground plane. Next, the operator 24 engages the hones 2 horizontal locking rest 22 with a supporting surface 28 (FIG. 7A). Once stable and comfortable, the operator 24 proceeds to sweep the instrument 26 along the whet-stones 14 surface to sharpen (FIG. 7B) If desired, while in a horizontal honing position, the operator 24 may place an angulated sharpening guide 30 within the whet-stone receptacle 12 guard walls 16 (FIGS. 8A-8B) The guide 30 will permit a mechanically predetermined sharpening angle. Finally, to sharpen, the operator 24 sweeps the instrument 26 along the guides 30 desired angle (FIG. 9).

Advantages

From the description above, a number of advantages of the instrument hone with whet-stone receptacle and hand guard become evident:

(a) The hone promotes industry standard honing methods with superior ergonomics
(b) Safety walls prevent injury by containing honing motion
(c) Safety walls improve technique by allowing a predictable honing path
(d) It permits the use of existing honing guides without having to manually secure them against a honing surface.
(e) The various locking rests and table rests afford superior stability during instrument honing
(f) The hone may be colored to quickly and easily designate whet-stone coarseness or grade Conclusion, Ramifications and Scope Accordingly, the reader will see that Instrument Hone with Whet-Stone Receptacle and Hand Guard can be used to easily and safely hone operative instrumentation. Moreover, it permits an ergonomic range of use that complies with clinically endorsed methods. It furthermore allows the hands free use of independent guides. The ergonomic design coupled with the stabilizing rests and peripheral safety walls ensure a superior honing operation with apex safety. Furthermore, the variably ergonomic hone with safety walls has additional advantages in that Places the operators hand out of the honing range thereby eliminating the chance for self injury
May permit the interchanging of various whet-stones for tailored honing preferences
Offers a design that is autoclavable
Reduces ergonomic stresses associated for having to clench small whetstones
Permits unparalleled stability for maximum honing effectiveness Although the description above contains much specificity, these should not be construed as limiting the scope of the invention but as merely providing illustrations of some of the presently preferred embodiments of this invention. For example, the handle may have any necessary shape or dimension. For example, it may be tubular or rectilinear, or any other shape (symmetrical or asymmetrical). The handle may be straight or incorporate any desirable angle. It may also have any degree of relationship with regard to its attachment or emergence from the whet-stone receptacle. Features such as finger apertures, finger grooves, or any other structural ergonomic aid may be incorporated when deemed necessary. Soft rubber grips may also be added to any aspect of the handle as need determine or where deemed necessary.

Any number of locking rests table rests or other supporting aids may be added. Grooves or channels may be incorporated into the handle for receptacle support. This would afford the operator greater stability and or increased honing orientation capabilities. For example with properly structured rests, an operator could deviate from strictly vertical or horizontal honing orientations. Additionally, the rests and locking rests may assume any size or shape as to permit greater safety and hone stability. An example of this would be a beveled base. This base would expand the stabilizing footprint of a table rest or locking rest. Lastly, soft rubberized grips may be incorporated into the table and locking rests to minimize potential slippage.

The whet-stone receptacle may assume any geometric shape and any dimension that promotes optimal sharpening. This includes any possible polygonal shape. Circular or elliptical dimensions of any degree may also be used. Also any number of caps, levers, or locking overhangs may be incorporated into any aspect of the hone. Caps and levers may also have hinges or other joint structures that aid cap removal and attachment. Lastly, the guard walls may be any height and assume angles or angles apertures that may be utilized as sharpening guides. Thus any feature can be incorporated in any degree when necessary and can be removed altogether if also deemed necessary.

Thus, the scope of the invention should be determined by the appended claims and their legal equivalents, rather than by the examples given.

The invention claimed is:

1. An instrument honing device comprising:

a receptacle containing an abrasive member;

an ergonomic gripping body, the gripping body having an asymmetrical V-shaped configuration comprised of an angled handle, a curved gripping contour and an acutely angled support for supporting said receptacle, the handle comprising a rest surface at a first free end of said gripping body and the support comprising another rest surface at a second free end of said gripping body; and wherein said receptacle is offsetly positioned on said support such that a vertical locking rest surface is defined by the support adjacent said second free end and a horizontal locking rest surface is defined by the receptacle adjacent said curved gripping contour.

2. The instrument honing device of claim 1 wherein said receptacle is a recessed volume having a desirable depth to form one or more guard walls to extend above said abrasive member when said abrasive member is contained therein.

3. The instrument honing device of claim 2 wherein said one or more guard walls have protrusions thereon to receive a removable guide.

4. The instrument honing device of claim 2 wherein said one or more guard walls have angled honing guides thereon to slidably communicate with an operative instrument and guide said operative instrument across said abrasive member at a consistent angle.

5. The instrument honing device of claim 1 wherein said receptacle has a securing means for removably holding said abrasive member within said protective holder.

6. The instrument honing device of claim 1 wherein said abrasive member is a coarse whet-stone.

7. The instrument honing device of claim 1 wherein said ergonomic gripping body enables a first gripping angle to position said abrasive member in a generally perpendicular orientation to a gripping hand and a second gripping angle to position said abrasive member in a generally parallel orientation to a gripping hand.

8. The instrument honing device of claim 1 wherein said ergonomic gripping body has an adjustably pivoting juncture with said receptacle to allow incrementally defined honing angulations.

9. The instrument honing device of claim 1 wherein said ergonomic gripping body is removably attached to said receptacle.

10. The instrument honing device of claim 1 wherein one of said rest surfaces has a groove to stably engage an angled surface.

11. A method to sharpen an operative instrument comprising the steps of;

(a) providing the instrument honing device of claim 1;

(b) providing an operative instrument for honing;

(c) selecting an appropriate gripping angle and repetitively sliding said operative instrument across said abrasive member.

* * * * *